United States Patent [19]

Wadell

[11] Patent Number: 4,471,823

[45] Date of Patent: Sep. 18, 1984

[54] LOG PROCESSING POSITIONING MEANS

[75] Inventor: Tord C. Wadell, Stockholm, Sweden

[73] Assignee: NPI New Products Investment AB, Sweden

[21] Appl. No.: 406,929

[22] Filed: Aug. 10, 1982

[51] Int. Cl.[3] ..... B27C 1/12

[52] U.S. Cl. ..... 144/246 F; 144/246 G; 144/249 A; 144/356; 144/377; 364/478

[58] Field of Search ..... 144/242 R, 242 G, 246 R, 144/246 F, 246 G, 249 A, 249 B, 376, 377, 378, 356, 357; 364/478, 505

[56] References Cited

U.S. PATENT DOCUMENTS

| | | | |
|---|---|---|---|
| 3,981,393 | 9/1976 | Landers | 144/242 C |
| 4,027,769 | 6/1977 | Hasenwinkle et al. | 144/246 R |
| 4,127,044 | 11/1978 | Kenyon | 144/249 A |

*Primary Examiner*—W. D. Bray

[57] ABSTRACT

Log processing positioning apparatus in which a log is brought to pass along a path from an input end of the same and through a log processing device at an output end of the path provided to divide the log into wood products. Between the input end and the processing device a scanner is provided to register the dimensions and shape of the log passing through the scanner. A computer is provided to receive and analyze the values registered by the scanner and relating to the dimensions and shape of the log by means of a program directed towards a number of cutting patterns and the position of the log in the processing device in order to divide the log into wood products so that the maximum yield is obtained. A first positioning device is provided to feed the log along the path, to move it transversally to the extension of the path and to turn the log along its longitudinal axis and provided to be governed by the computer in order to give the log said intended position. A further positioning device is provided to feed the log into the processing device and to hold the same in the intended position and if necessary adjust the position of the log so that the intended position is kept. The first positioning device is provided with an arrangement of rotable feeding rolls each with an axis transverse to the path and situated around the intended position for the log. Moving devices for the rolls are provided to move said rolls outwards and inwards in relation to the intended position for the log. Turning devices are provided to turn the arrangement of the rolls around said path and consequently the log around its center axis.

4 Claims, 8 Drawing Figures

LOG PROCESSING POSITIONING MEANS

The present invention relates to an apparatus for the adjusting of a log into a position in front of a cutting means such as a saw mill and into the same in a way that the maximum yield is obtained in the form of wood products.

It is known for example from U.S. Pat. Nos. 3,736,968 Mason, 4,139,035 Bystedt et al and 4,185,672, Vit et al to provide apparatuses and methods for processing logs to obtain an optimum amount of wood products of a predetermined quality from each log. The relevant methods include the steps of positioning each log along a reference axis, electronically scanning the log to determine searching of each dimension with respect to the reference axis, computing said dimensions in order to analyse tne best distribution of the saw cuts and positioning the log in the position relating to the predetermined cutting lines for the best obtainable yield when the log is passed through the saw mill.

In the known apparatuses and methods, for example the same relating to the above mentioned references, the handling of the log is made in a schematical way which means less demands according to the apparatus but at the same time a relatively low degree of utilizing of the log in order to obtain the maximum economical profit of the same.

The object of the present invention is to provide an apparatus for the handling of logs which allows that a better yield is obtained than in prior known apparatuses and methods.

The object of the invention is obtained by means of an apparatus in which the log can be positioned in the most efficient way according to the best yield after dividing the same in a saw mill and allowing the log to be adjusted in all directions including its angular position before it enters the mill and also adjusted during the sawing operation in order to let the cutting line follow the contour of the log.

The invention will be described in the following with reference to the accompanying drawings, showing by way of illustration the preferred embodiment thereof, and in which.

Figure 1:
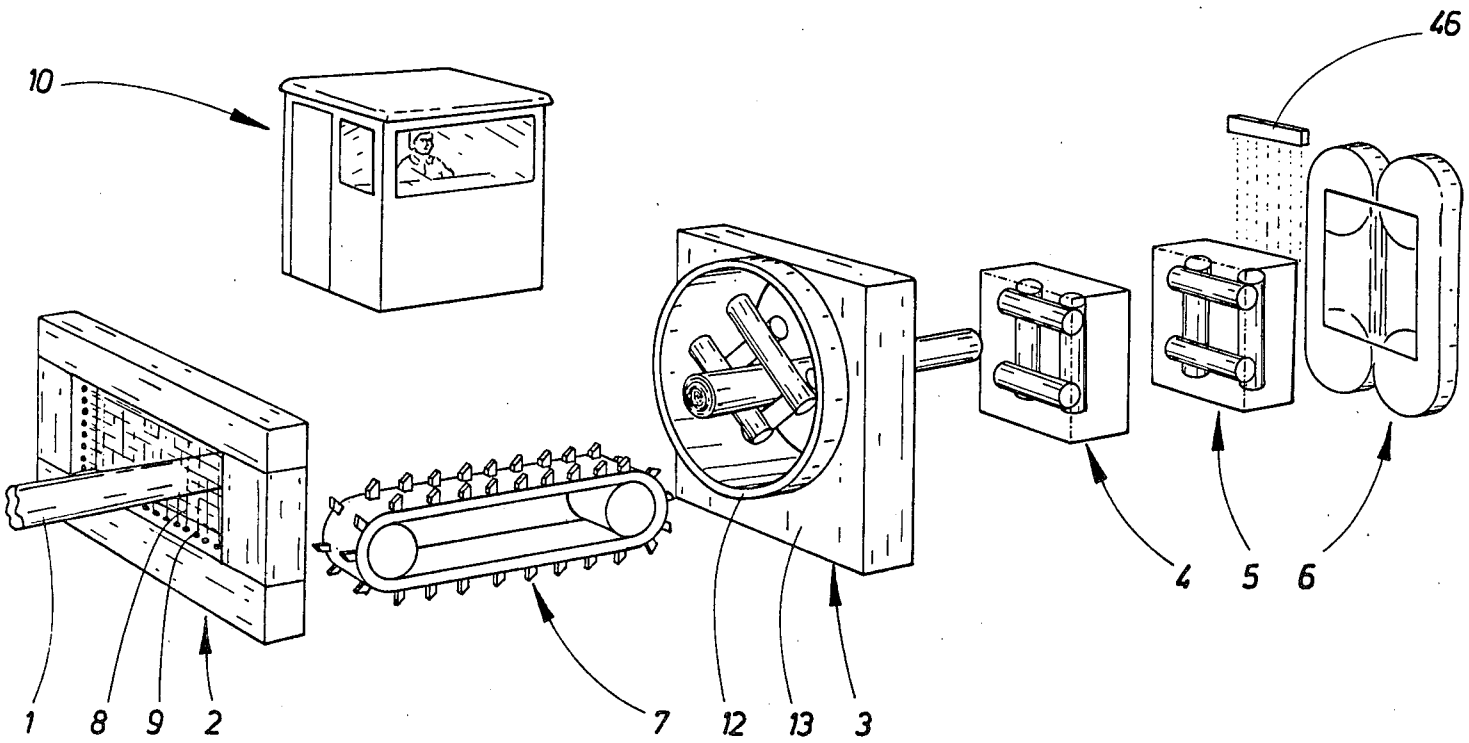
FIG. 1 shows a perspective view of an apparatus according to the invention.

According to FIG. 1 the apparatus is adapted to move a log 1 along a path from a magazine (not shown) through a scanner 2, a first positioning means 3, a second positioning means 4 and a third positioning means 5 to and through a processor 6, a kind of cutting means such as a saw mill for the dividing of a the log into wood products. The apparatus is also provided with a chain conveyor 7 at least in the area between the scanner 2 and the first positioning means 3. Conveying means also have to be provided in the front of the scanner for the deliverance of the log to the scanner. Such conveying means are however well known in the prior art and will not be described in detail.

In the scanner 2 the diminsions and the shape of the log are determined by means of light beams 8 from some kind of light sources and photo sensing means 9. For a number of cross sections of the log the relevant dimensions and shapes are sensed by means of the photo sensing means when the log breaks the light beams. The successive obtained values for the dimensions and shapes are transmitted to a computer and these values are tabulated as a order to determine the shape of the log in whole i.e. the relative position between the subsequent cross sections. Preferably, the output from the scanner can be corrected manually by a supervisor in a cabin 10, which is placed for the best sight over the apparatus. By means of such manual correction damages such as decayed parts of the log can be taken into consideration and not only the form characteristics by planning of the cutting pattern for the log by means of the computer.

Figure 2:
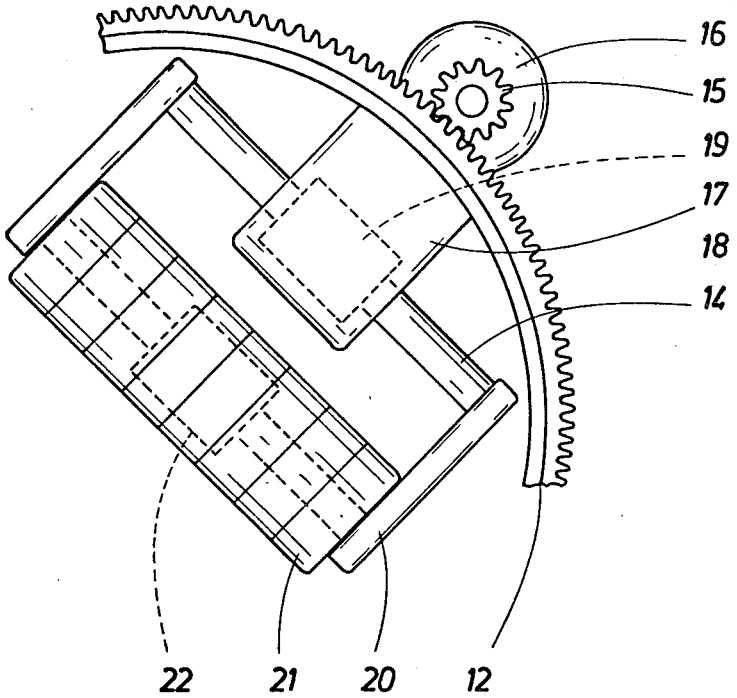
FIG. 2 shows a first part of the apparatus.

From the scanner 2 the log 1 is moved by means of the conveyor 7 to the first positioning means 3. According to FIG. 2 the first positioning means 3 comprises a ring 12 which is carried in a rotatable way in a frame 13 (FIG. 1). The ring 12 has cogs 14 on its outside which are provided to cooperate with a driving gear 15 which can be rotated by means of a motor 16. On the inside of the ring 12 there are arranged four housings 17 each carrying a shaft 18 which can be turned by means of a motor 19 in the respective housing. The free end of each shaft 18 carries an arm 20. Between the free ends of the two arms 20 of each shaft 18 a feeding roll 21 extends which can be rotated by means of a motor 22 connected to the roll and to the arms 20.

By means of the motors 19 the arms 20 can be pivoted and the respective feeding rolls 21 can thereby be positioned with its inner part at different positions from the center of the ring 12. By means of the maneuvering of all the four rolls 21 it is possible to form a square opening through the ring. The dimension as well as the position of this opening can be changed within the limit dictated by the width of the ring 12. The rolls 21 are serrated or toothed and by means of the rotation of the rolls a log can be fed through the first positioning means 3 at a height and side position which is determined by means of the pivoting of the arms 20. After the log has been caught by the rolls the same can be turned if the ring 12 is rotated by means of the motor 16. As a result the log can be fed out from the first positioning means in every decided position.

Figure 3:
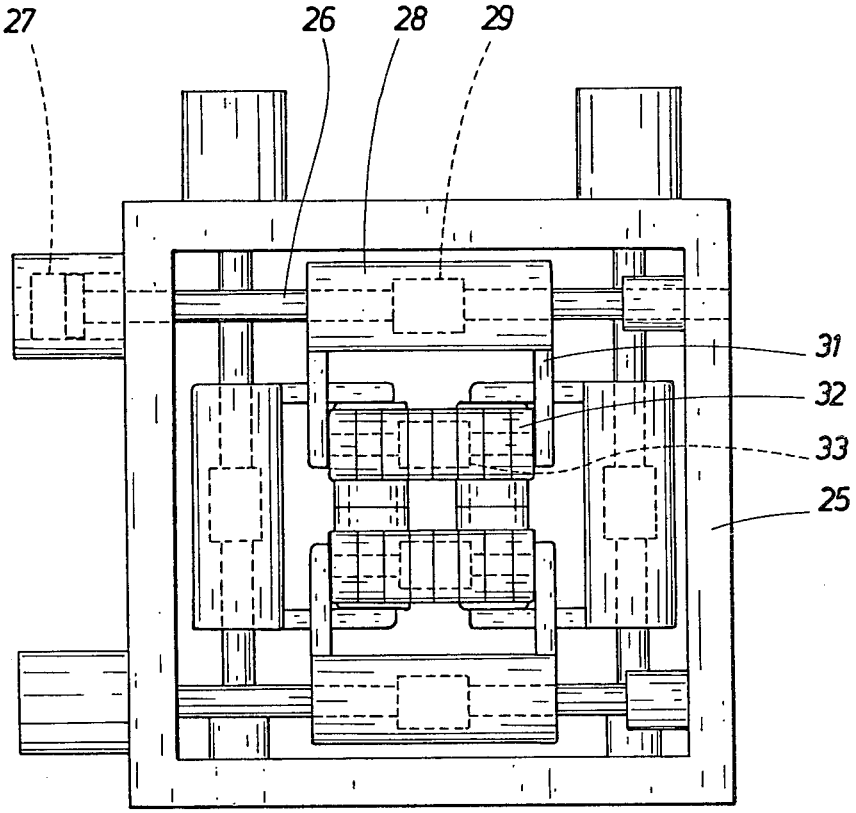
FIG. 3 shows a second part of the apparatus.

When the log 1 is fed out from the first positioning means 3 the same is fed into the second positioning means 4 evident from FIG. 3. According to this Fig. the second positioning means as well as the third positioning means 5, the two positioning means 4 and 5 are equal to each other, comprise a frame 25 in which four rods 26 are carried in a square arrangement. Each rod is movable in its longitudinal direction by means of hydraulic cylinder 27 on the frame. Each rod 26 carries a housing 28 which can be turned on the rod by means of a motor 29. The housings each carry two arms 31 which by turning of the respective housing can be pivoted. The free ends of the arms 31 are connected by means of a roll 32 which can be rotated by means of a motor 33 connected to the roll and to the arms.

Consequently, also through the second and the third positioning means an opening for the log can be formed and positioned in every position within the limit of the frame. The feeding rolls 32 are not able to be turned around said opening as is possible with the rolls of the first positioning means by means of the ring 12. In spite of this it is possible to adjust the angular position of a log fed through the second and the third positioning means by adjusting the rolls 32 in their longitudinal directions by means of the cylinders 27. By such turning of the log all the four rolls have to cooperate. In this way the log can be turned but not to the same extent as in of the first positioning means. On the other hand the second and the third positioning means are able to be built smaller than the first positioning means and with less main parts.

As is understood from the foregoing the power means for the adjusting of the log as well as the feeding of the same by its passage through the positioning means consists of the motors mentioned and the hydraulic cylinders 27. Preferably these motors are of the hydraulic type and thereby all adjustments of the log can be made by means of a hydraulic system connected to said motors and hydraulic cylinders. Such a hydraulic system is well adapted to be governed by means of valves activated by electrical means which can be connected to the computer mentioned for the governing of the positioning and feeding of the log.

The processing means 6 for the dividing of the log can be of any conventional type. Shown in FIG. 1 are two band saws capable of making two cuts in the log. However, the saw means can alternatively be a frame saw. The saw means can also be completed with chipping means for the forming of one or several surfaces of the log. Also a more unconventional means such as laser cutting means can be used in the means for the dividing of the log into wood products such as planks. The dividing of the log into wood products will result in some waste materials which can be produced in the form of wood chips.

The dimension and the shape of the respective logs will result in that different logs have to be cut in different ways according to the positioning of the cutting pattern forming the intended wood articles obtained from the log. That means that the respective logs has to be positioned in a certain way relative to the cutting means. In order to divide the entire log into the intended wood products it can be possible to pass the log several times through the cutting means in order to reduce the cutting tools in the cutting means. For every time the log, respectively the reduced log, is passed through the cutting means it has to be repositioned in order to be inserted in the right position for the new cutting operation. If the log in this way is passed through the cutting means several times it is possible to change the cutting pattern to a wide extent by repositioning the log before every cutting operation. If the cutting means includes several cutting tools it may be necessary to change the relative position between these tools when the cutting pattern is changed. Consequently, the cutting means used in connection with the invention can include one or several cutting tools for the making of one or several cuts at a time and it can be provided with tools in a fixed or in changeable positions in relation to each other. When one or several chippers are included for the shaping of a certain profile surface of the log it may be necessary to change these chippers not only with respect to their positions but also with respect to their shaping profile.

The positioning means described are able to move the log in all directions, accordingly also to raise and lower the same. However, most conveying means such as the conveying means 7 shown are not able to raise and lower the log but only to feed it in its longitudinal direction. If consequently the log is raised in the positioning means over the transportation level of the conveying means it will lose contact with the latter. If the cutting means is provided only with cutting tools making vertical cuts it is not necessary to raise the log and no problems will occur with respect to the conveying means. If, on the other hand the cutting means is able to make horizontal cuts it will be necessary to position the log in a certain position in a vertical direction. Thereby it is possible to adapt the first positioning means 3 to the level of the conveying means 7 when the log is fed into the positioning means mentioned and then to raise the log when it is carried by said positioning means. If conveying means or support means for the log are arranged between the different positioning means and between the same and the cutting means also the conveying and supporting means have to be adjustable in vertical direction in order to adapt them to the position of the log which in turn is adapted to the cutting tool for the horizontal cuts. Also such an adjustment can be made by means of hydraulic cylinders by means of electrically activated valves connected to the computer.

Figure 4:
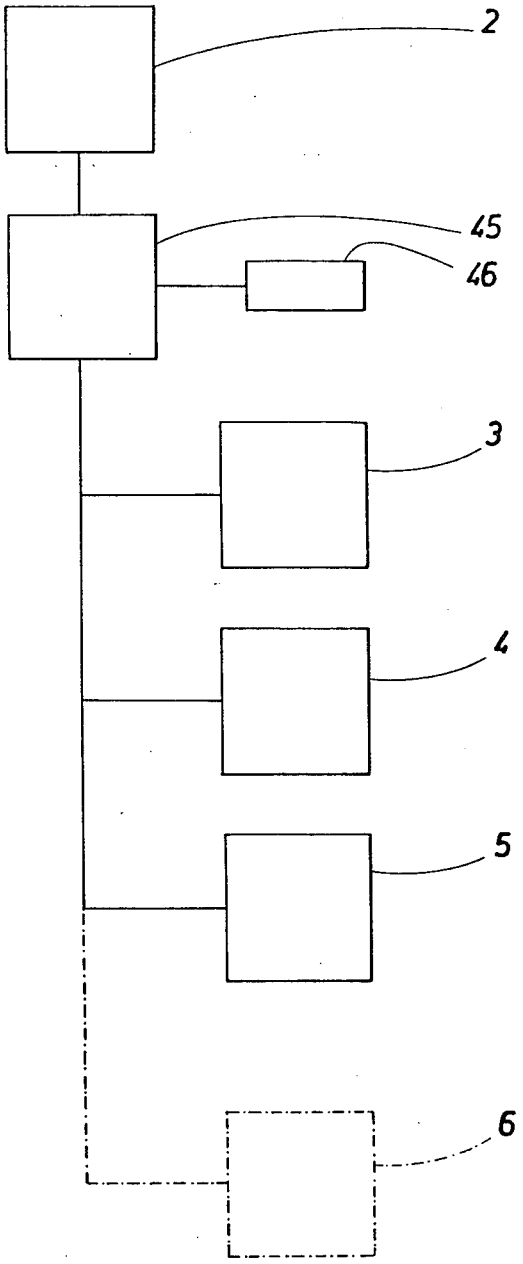
FIG. 4 shows a diagram illustrating in a schematical way the function of the apparatus.

In the diagram in FIG. 4 is shown the main units of the apparatus. As is evident from the figure the scanner 2 is connected to the said computer with the reference number 45. The computer is programmed to analyse the dimension values from the scanning of the log and to determine the cutting pattern and the position of the log in relation to the cutting tools. According to this, governing signals are submitted to the different positioning means 3, 4 and 5. Preferably, the computer determines two index cross sections and determines from the analysis how these two cross sections have to orient also with reference to their angular positions. Alternatively as index the center line of the log and the angular postion of one cross section can be used. Preferably, the apparatus includes a second scanning means, the control scanning means 46 in front of the cutting means 6. By means of this control scanning means the position of the log by means of its index cross sections can be checked before it enters the cutting means so that the log can be adjusted if it has changed its position during the passing through the positioning means. The first positioning means 3 receives the log from the scanning means and is able to change the position of the log and turn the same according to the difference between the scanned position of the log and the intended cutting position. Because of irregulars in the shape of the log it can however be moved out of the intended position during the feeding but this incorrectness can be corrected in the way described. The control scanning means is consequently only for the checking of the position of the log and not for analysis of its dimensions as the first mentioned scanning means.

As is shown in FIG. 4 with dashed dotted lines the computer can also be used for the change of the position of the cutting tools so that they can be adapted to the determined cutting pattern as described before.

Figure 5:
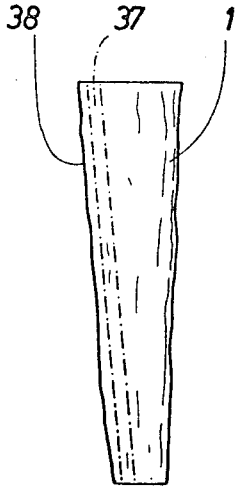
FIGS. 5 to 8 inclusive shows different cutting patterns for logs.
Figure 6:
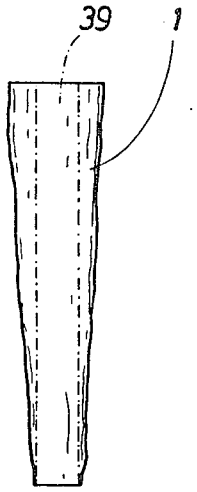
Figure 7:
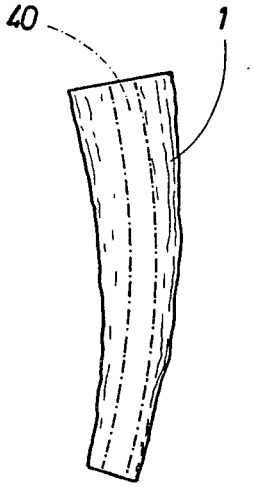
Figure 8:
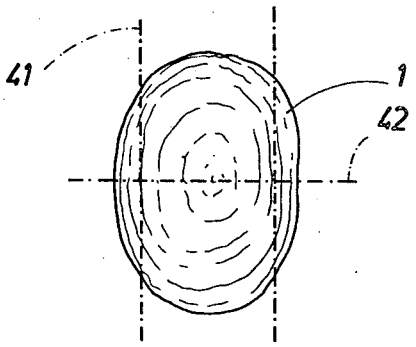

In FIG. 5–8 is schematically shown different cutting patterns. In FIG. 5 is shown what is called taper sawing. The log 1 is cut along lines 37 parallel to one of its sides 38. In FIG. 6 is shown a log in which the cutting lines 39 are oriented parallel to the center line of the log. This pattern is choosen when it is important to orientate the fibres in the resulting wood products parallel to the outer surfaces of the same. In FIG. 7 is shown a bowed log in which the cutting lines 40 are parallel to the bent center line of the log. By such a cutting pattern the volume of the log can be utilized in the best way and the resulting bowed planks will be plane after a period of storing. By such a non-linear cutting the positioning means have to change the position of the log during its passing through the cutting means in order to let it follow a non-linear cutting line. In FIG. 8 is shown the end surface of a log. The cross section of the log is elongated and with the cutting lines 41 it is shown how planks of the maximum obtainable width can be cut from the log if it is turned with its widest center plane parallel to the cutting line. With the alternative cutting line 42 is shown how the volume of the log can be better utilized if it is cut parallel to its narrowest center plane. Accordingly, the computer has to be programmed for certain preferred dimensions of the wood products or the maximum volume yield according to current economical factors.

By processing a log, the same is fed through the scanner in order to determine its dimension and shape. The values obtained are analysed in the computer according to the program choosen and this analysis results in governing signals to the positioning means.

Accordingly, the first positioning means 3 is receives signals so that the log is turned to the intended angular position and moved vertically and horizontally to the intended position in relation to the processing means 6. By the means of the rolls 20 the log is fed into the second position means 4 and then to the third positioning means 5. In these positioning means the position of the log can be adjusted by means of pivoting of the respective arms so that the feeding rolls 32 are moved outwards or inwards in relation to the frame. Also the angular position can be adjusted by means of the cylinders 27 which will move the rolls 32 in axial direction.

In this way the log can be adjusted to the exact right position, checked by means of the control scanning means 46 before the log enters the cutting means and, as described, also during its passing through the cutting means.

I claim:

1. Log processing positioning means in which a log is moved along a path from an input end to an output end of said path comprising a log processing means at the output end of the path through which said log is movable and operable to divide the log into wood products, a scanning means positioned between said input end of said path and said processing means through which said log is movable and operable to register the dimensions and shape of the log passing therethrough, a computer means connected to said scanning means operable to receive and analyze the values registered by the scanning means, said computer means relating to the dimensions and shape of the log by means of a program directed towards a number of cutting patterns and the position of the log in the processing means in order to divide the log into wood products so that a maximum yield is obtained, a first positioning means located and operable to feed the log along the path and move it transverse to the path and turn the log along its longitudinal axis, said first positioning means being connected to and governed by the computer in order to give the log an intended position for dividing same according to a chosen cutting pattern, and further positioning means positioned and operable to feed the log into the processing means and to hold the log in the intended position and if necessary adjust the position of the log so that the intended position is kept, said first positioning means being provided with an arrangement of rotatable feeding rolls each having an axis transverse to the path and situated around the intended position of the log, moving means for the rolls for moving said rolls outwardly and inwardly in relation to said intended position of the log, and turning means for turning the arrangement of the rolls around said path and consequently the intended position for the center axis of the log.

2. Log processing positioning means according to claim 1, wherein said further positioning means comprise a frame, an arrangement of four rotatable feeding rolls provided in said frame, the axis of each of the last named rolls being transverse to said path, moving means for moving said last named rolls outwardly and inwardly relative to said intended position of the log, and means for displacing each of said last named rolls in a direction parallel to the direction of its rotational axis.

3. Log processing positioning means according to claim 2, wherein a second scanning means is placed in the front of the processing means to register the position of at least two index positions of the log, said second scanning means being connected to the computer, said computer being connected to said further positioning means and being operable to govern the further positioning means according to the possible difference between the intended position of the log determined by the computer according to the values registered by the first said scanning means and according to the computer program and the real position of the log at the second scanning means in order to adjust the log to its intended position if necessary.

4. Log processing positioning means comprising a first positioning means and a second positioning means disposed in a path along which a log is moved, a scanning means disposed in said path, a processing means disposed in said path, said log being movable through said scanning means, through said first and second positioning means and then into said processing means which receives said log in a position predetermined by an analysis of the dimensions and shape of the log registered in the scanning means for dividing the log according to a cutting pattern into wood products, said first positioning means comprising a frame, a rotatable ring in said frame, power means for rotating said ring, a plurality of housings mounted on the inside of the ring each carrying a shaft disposed in the ring transverse to said path, each shaft carrying one end of at least one arm, power means for rotating the shaft and pivoting its respective arm, a feeding roll extending from the other end of said arm, said feeding roll having an axis which is substantially parallel to its respective shaft, and said second positioning means comprising a frame, four rods carried in said frame forming a square arrangement around the path of the log and substantially transverse to said path, power means for displacing the rods along their longitudinal directions, a housing mounted on each rod, one end of at least one arm carried by the housing, power means for turning the housing to pivot said last named arm, a feeding roll connected to the other end of said last named arm, said last named feeding roll having an axis which is substantially parallel to its respective rod, and power means for rotating said last named feeding roll.

* * * * *